United States Patent [19]

Kimmett et al.

[11] 4,424,949

[45] Jan. 10, 1984

[54] PAINT TRAY SUPPORT

[75] Inventors: James P. Kimmett, 703 N. Pierce St., Delphos, Ohio 45833; Leo Geise, Delphos, Ohio

[73] Assignee: James P. Kimmett, Delphos, Ohio

[21] Appl. No.: 242,593

[22] Filed: Mar. 11, 1981

[51] Int. Cl.[3] ..... A47G 29/02

[52] U.S. Cl. ..... 248/238; 15/257.06; 220/18

[58] Field of Search ..... 248/238, 211, 210, 310; 220/18; 15/257.06; 108/152

[56] References Cited

U.S. PATENT DOCUMENTS

| | | | |
|---|---|---|---|
| 2,759,620 | 8/1956 | Pharris | 248/211 |
| 3,103,334 | 9/1963 | Thoms | 248/238 |
| 3,822,846 | 7/1974 | Jesionowski | 248/210 |
| 3,829,051 | 8/1974 | Emmons | 248/238 |
| 4,222,541 | 9/1980 | Cillis | 248/210 |

*Primary Examiner*—William H. Schultz
*Assistant Examiner*—Ramon O. Ramirez
*Attorney, Agent, or Firm*—Emch, Schaffer & Schaub Co.

[57] ABSTRACT

An adjustable paint tray support for use on a ladder having a bracket for attaching to one of the legs of the ladder is disclosed. The bracket contains a section for engaging one of the steps or rungs on the ladder. A support member for the paint tray is pivotally connected to the bracket. The support member has a raised portion at each end for engaging the paint tray. A clamp is positioned on the bracket to engage a portion of the support member to releasably secure the support member with respect to the bracket.

12 Claims, 13 Drawing Figures

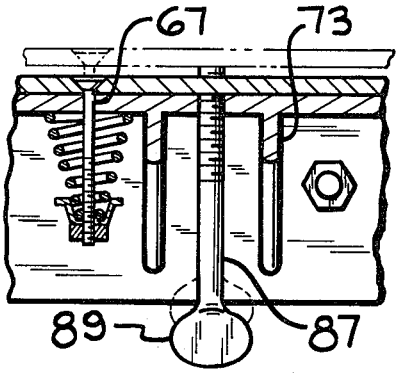
FIG. 6
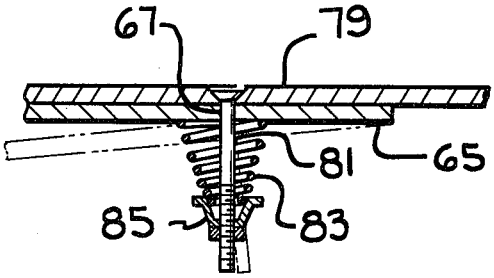
FIG. 7
FIG. 5
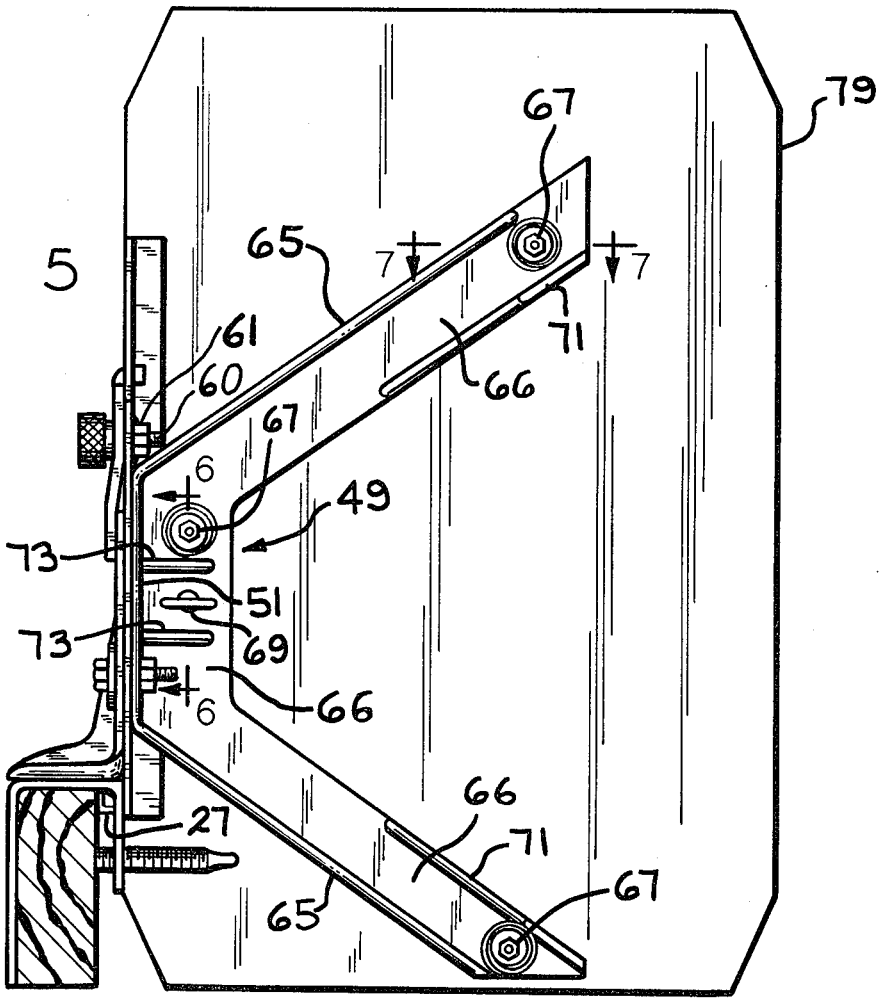

PAINT TRAY SUPPORT

BACKGROUND OF THE INVENTION

The invention relates to a support for a paint tray and a new embodiment for a paint tray. More particularly the paint tray support is designed for attachment to a ladder whereby the position of the support can be varied to achieve the desired location for a paint tray located on the support. The new embodiment for the paint tray has an enclosed end that forms a container for the paint normally positioned in the tray. In one of the more specific aspects of this invention, the paint tray is adapted with brackets that assist in securing the paint tray to the paint tray support.

The use of rollers for painting has become widespread and is generally accepted to be the most economical and practical way to apply paint to a surface. The paint for such painting is normally contained in a tray having a paint storage area and a slanted work surface where the paint is positioned on the roller. However, it is difficult to use such a paint tray when painting from a ladder. The paint trays are not well suited for securing to a ladder and the paint trays are usually in a location on the ladder that makes it difficult to use the paint trays.

Accordingly, there is need for a support that can be attached to a ladder for supporting a paint tray in a location that is convenient for painting. In addition, the support should be adjustable so that it will be adaptable for use in a number of locations, on different ladders and for different orientations of the ladder with respect to the surface that is to be painted.

It is also difficult to move the paint tray or position paint trays on the ladder when they are filled with paint. As the paint tray normally defines a relatively shallow container that is relatively flat it is easy to tip and spill paint from the paint tray. Accordingly, there is a need for a paint tray having an enclosed end that defines a receptable for the paint that is less susceptible to tipping and spilling. Further, the paint tray should contain a handle to facilitate carrying the paint tray with the paint located in the enclosed end.

SUMMARY OF THE INVENTION

According to the invention, there is provided an adjustable paint tray support for use on a ladder comprising a bracket for attaching to one of the legs of the ladder. The bracket contains a section for engaging one of the steps or rungs on the ladder. A support member for the paint tray is pivotally connected to the bracket. The support member has a raised portion at each end for engaging the paint tray. A clamp is positioned on the bracket to engage a portion of the support member to releasably secure the support member with respect to the bracket.

There is also provided according to the invention a paint tray comprising a base defining a paint retention area. A work surface is connected to the base and the work surface is positioned at an angle with respect to the base. A front wall extends from the base and the front wall is positioned on the end of the base that is spaced apart from the work surface. The front wall is positioned substantially perpendicular to the base. A top wall is connected to the front wall and the top wall extends substantially over the base. The top wall is also positioned substantially parallel to the base. A rear wall is positioned in contact with the end of the work surface that is spaced apart from the base. The rear wall extends from the work surface in a direction that is substantially parallel to the front wall. The rear wall extends to a point that is substantially in alignment with the mid point of the front wall. Sidewalls extend from the rear wall to the front wall. The sidewalls are also in contact with the base, the work surface and the top wall. At least one foot is positioned in contact with the rear wall where said foot extends from the rear wall in a direction substantially parallel to the rear wall and towards the base. The foot terminates at a point that is substantially in alignment with the base.

It is an object of the invention to provide a paint tray support that can be varied in position to obtain the correct working position for a paint tray.

It is also an object of the invention to provide a paint tray support that is adaptable for use with a wide range of ladders.

It is an additional object of the invention to provide a paint tray having an enclosed end for retaining and carrying paint in the paint tray.

It is a further object of the invention to provide a paint tray with an enclosed end and having a handle to facilitate the carrying of the paint tray when the paint is located in the enclosed end.

Other objects and advantages of the invention will become apparent as the invention is described hereinafter in detail and with reference to the accompanying drawings.

DESCRIPTION OF THE DRAWINGS

FIG. 5 is a bottom view of the paint tray support;

FIG. 6 is a cross sectional view of the invention taken along line 6—6 in FIG. 5;

FIG. 7 is a cross sectional view of the paint tray support taken along line 7—7 in FIG. 5;

DESCRIPTION OF THE PREFERRED EMBODIMENTS

Figure 1:
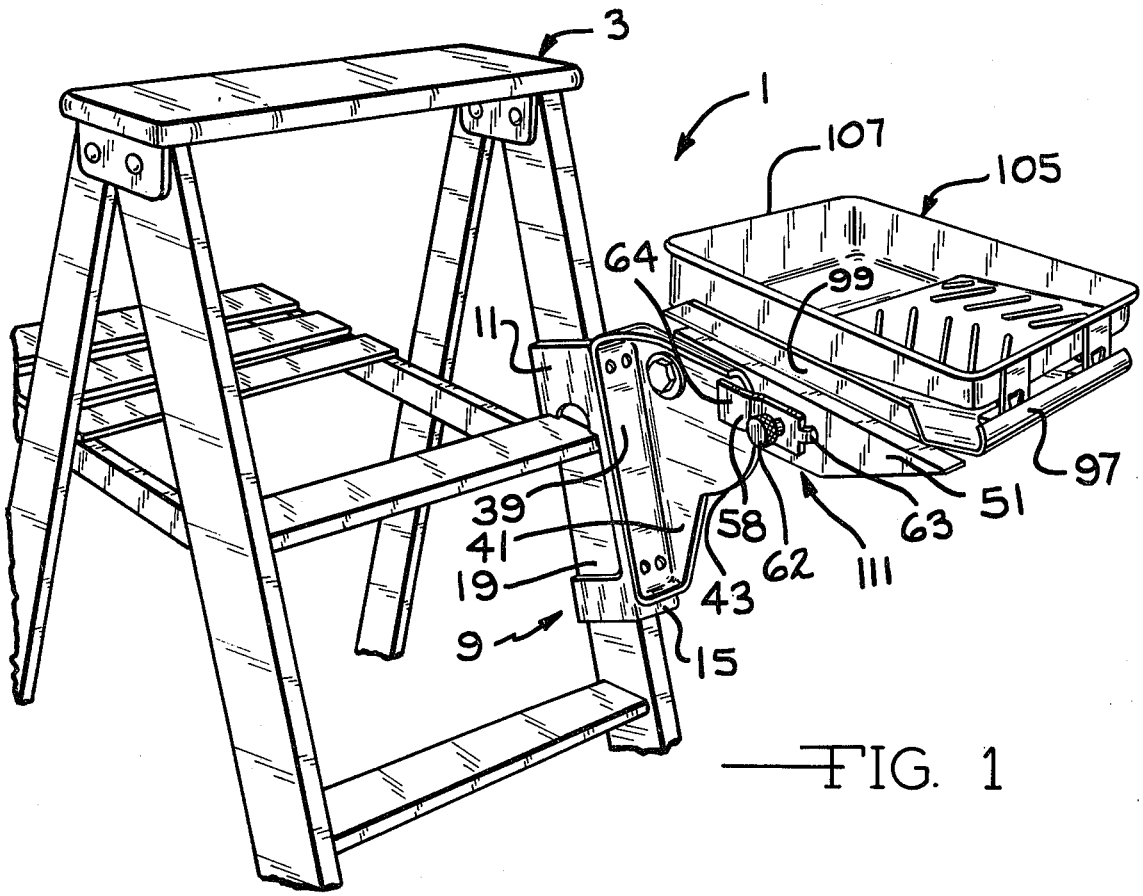
FIG. 1 is a perspective view of the paint tray support in accordance with the present invention.

The present invention relates to a support for a paint tray that can be attached to the leg of a ladder and an improved paint tray that can be used with the support. More particularly the support member is pivotally adjustable with respect to the ladder and horizontally adjustable with respect to the ladder so that the support member can be maintained in the proper position for supporting a paint tray.

The details of the invention will be more fully understood by referring to the attached drawings in connection with the following description.

The paint tray support 1 of the present invention is designed for use with either a step ladder 3 or an extension ladder 5. The paint tray support includes a generally u-shaped bracket 9 that is adapted for positioning on one leg of a ladder. The u-shaped bracket 9 has a first leg 11 and a second leg 13 that are in opposed substantially parallel relationship. The first and second legs of the bracket 9 are connected together by third leg 15. The third leg 15 is substantially perpendicular to the first and second legs of the bracket 9. The u-shaped bracket 9 is constructed so that it will fit over the leg of a ladder.

The first leg 11 of the bracket 9 contains an opening 19. The opening extends from the edge of the first leg 11 that is spaced apart from the third leg 15 to a point on said first leg that is substantially centered in the first leg. One end of the opening 19 defines a slot 21 that is adapted to engage a substantially rectangular step on a step ladder or similar ladder. The slot 21 terminates in a projection 23 at the edge of the first leg 11 that is spaced apart from the third leg 15. The projection 23 is disposed to extend over one end of the generally rectangular step to assist in securing the step in position in the slot 21. The opening 19 also includes a radiused or curved section 25 that is adapted for engaging a substantially round rung on an extension ladder or other similar ladder.

A spacer 27 is positioned in the bracket 9 at the juncture of the second leg 13 and the third leg 15. The spacer extends from the third leg 15 in a direction towards the open end of the bracket 9. The spacer is disposed to allow the bracket 9 to accomodate ladders that have legs of varying width and depth.

The second leg 13 of the bracket 9 does not extend from the third leg 15 as far as the first leg 11. The second leg 13 contains the threaded aperture 29 and a threaded bolt 31 is rotatably positioned in said aperture. The threaded bolt contains a flange or knob 33 on the end of the bolt that is spaced apart from the second leg 13 to facilitate the rotation of the threaded bolt. The threaded bolt 31 is positioned so that it can be advanced to contact the leg of the ladder to secure the bracket 9 to the leg of the ladder.

The bracket 9 is constructed so that the first and second legs of the bracket will straddle the leg of the ladder to which the paint tray support is being attached. The first leg 11 of the bracket will normally be positioned adjacent the interior side of the leg of the ladder where the steps or rungs for the ladder are positioned. The second leg 13 is normally positioned on the exterior side of the leg of the ladder. The third leg 15 of the bracket 9 is positioned in contact with or adjacent the front edge of the leg of the ladder.

A flange 37 is connected to the u-shaped bracket 9. The flange contains a first section 39 that is positioned adjacent and secured to the third leg 15 of the bracket 9. The first section 39 is secured to the leg 15 by any suitable fastening means such as the screws shown or by welding. The flange has a second section 41 that extends from the first section 39 in a direction that is substantially perpendicular to the first section. The second section 41 is positioned on the third leg 15 so that the second section is in substantial alignment with the second leg 13 of the u-shaped bracket 9. The second section 41 includes a radiused section 43 on the edge of the second section that is spaced apart from the first section 39. The second section 41 also contains an aperture 45.

A support frame 49 is positioned in contact with the flange 37. The support frame has a base 51 that is positioned adjacent the second section 41 of the flange 37. The base contains a first aperture 53 that is in alignment with the aperture 45 in the second section 41 of the flange. A bolt 55 is positioned in the aperture 45 and the aperture 53 to pivotally connect the support frame 49 to the second secton 41 of the flange 57.

A second aperture 56 and an opening 57 are positioned in the base 51 of the support frame 49. A clamp member 58 is positioned adjacent the base 51. The clamp member contains an aperture 59 that is in alignment with the second aperture 56 in the base 51. A bolt 60 is positioned in the second aperture 56 and the aperture 59 in the clamp member to secure the clamp member to the base. A nut 61 is positioned on one end of the bolt 60 and the other end of the bolt contains a knurled knob 62.

One end of the clamp member 58 contains a tab 63 that extends into the opening 57 in the base 51. The tab acts to prevent the clamp member 58 from pivoting around the bolt 60. The other end 64 of the clamp member 58 extends into releasable clamping engagement with the radiused section 43 of the flange 37.

Projecting from the base 51 are two ribs 65. A generally v-shaped support plate 66 is positioned in contact with one edge of the base 51 and the edges of the ribs 65. The support plate contains apertures 67 and threaded aperture 69. Gussetts 71 can be positioned along the edge of the support plate adjacent the ribs 65 to provide additional support for this portion of the support plate. Gussetts 73 can be provided between the base 51 and the support plate 66 adjacent the base to provide additional support for this portion of the support plate.

Positioned on the support plate 66 is support member 79. The support member has a plurality of pins 81 that are in alignment with the apertures 67 in the generally v-shaped support plate 66. The pins pass through the aperture 67 and the pins are biased so that the support members 79 are urged toward the support plate 66. Ususally a spring 83 is positioned around the portion of the pin 81 that extends through the support plate 66. One end of the spring is in contact with the support plate 66 and the other end of the spring is in contact with a nut 85 located on the end of the pin. The spring 83 acts upon the nut 85 to bias the pin 81 and the support member 79 towards the support plate 66. In this fashion, the support member 79 is moveably secured to the support plate 66.

A threaded bolt 87 is positioned in the threaded aperture 69 in the support plate 66. The threaded end of the bolt 87 extends through the support plate 66 and is in contact with the support 79. A handle or knob 89 can be provided on the other end of the bolt to facilitate the rotation of the bolt. The bolt 87 can be advanced to vary the position of the support member 79 with respect to the support plate 66.

One end of the support member 79 contains a front wall 93 that extends from the support members 79 in a direction that is substantially perpendicular to the support member. At the end of the front wall 93 that is spaced apart from the support member 79 there is a lip 95 that is positioned at an angle with respect to the front wall 93. The lip 95 is positioned so that it extends towards the interior surface of the support member 79. The end of the support member 79 that is opposite to the front wall 93 contains back wall 97. The back wall 97 extends from the support member 79 in a direction that is substantially perpendicular to the support member. Positioned along each side of the support member 79 are shoulders 99. The shoulders extend in a direction that is substantially perpendicular to the support members 79.

Positioned on the support members 79 is a paint tray 105. The paint tray 105 is of normal construction and the front 107 of the paint tray engages the front wall 93 on one end of the support member and the feet 109 are positioned adjacent the back wall 97 on the other end of the support member 79. The paint tray 105 is also positioned between and adjacent the shoulders 99 on the support member 79. Accordingly, the paint tray 105 is maintained in position on the support member 79 by the front wall 93, back wall 97 and shoulders 99.

FIGS. 8–13 show another embodiment of a paint tray that can be used with the paint tray support of the present invention. The paint tray 115 is substantially similar to paint tray 105 with the exception that one end 117 of the paint tray is enclosed. The paint tray has a base 121 that is located at the enclosed end of the tray. Connected to one end of the base 121 is front wall 119. The front wall extends from the base in a direction that is substantially perpendicular to the base. Connected to the other end of the base is a transition section 123 that extends from the base at an angle. Connected to the transition section is work surface 125. The work surface 125 is positioned at an angle with respect to the transition section 123. The end of the work surface 125 opposite the transition section 123 connects with rear wall 127. The rear wall extends from the work surface in a direction that is substantially perpendicular to the work surface. The rear wall 127 also extends in the same direction that the front wall 119 extends from the base 121. The rear wall 127 and front wall 119 are substantially parallel. The rear wall 127 terminates at a point that is substantially the same height as the mid point of the front wall 119. Connected to the front wall 119 is a top wall 129. The top wall is connected to the portion of the front wall 119 that is spaced apart from the base 121. The top wall extends from the front wall in a direction that is substantially perpendicular to the front wall. The top wall is substantially parallel to the base 121 and the top wall is positioned so that it extends over the base 121. Sidewalls 131 are positioned along each side of the paint tray. The side walls are in contact with the base 121, transition section 123, work surface 125, front wall 119, rear wall 127 and top wall 129. The sidewalls 131 extend in an angled section 133 from the top wall 129 in a direction towards the work surface 125. The angled section 133 terminates at a point 135 that is substantially in alignment with the portion of the rear wall 127 that is spaced apart from the work surface 125. From the point 135 the sidewalls extend to the end of the rear wall that is spaced apart from the work surface 125.

Figure 9:
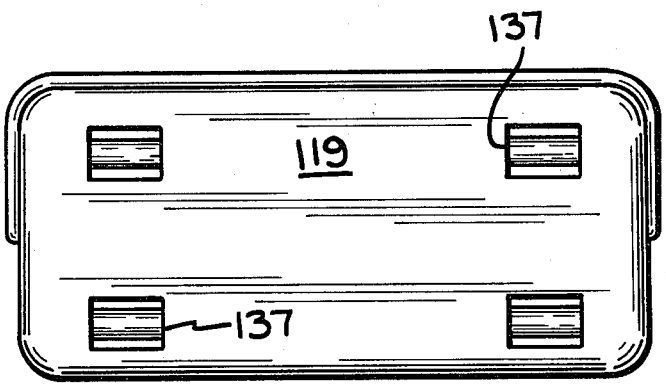
FIG. 9 is a front elevational view of the paint tray shown in FIG. 8.
Figure 10:
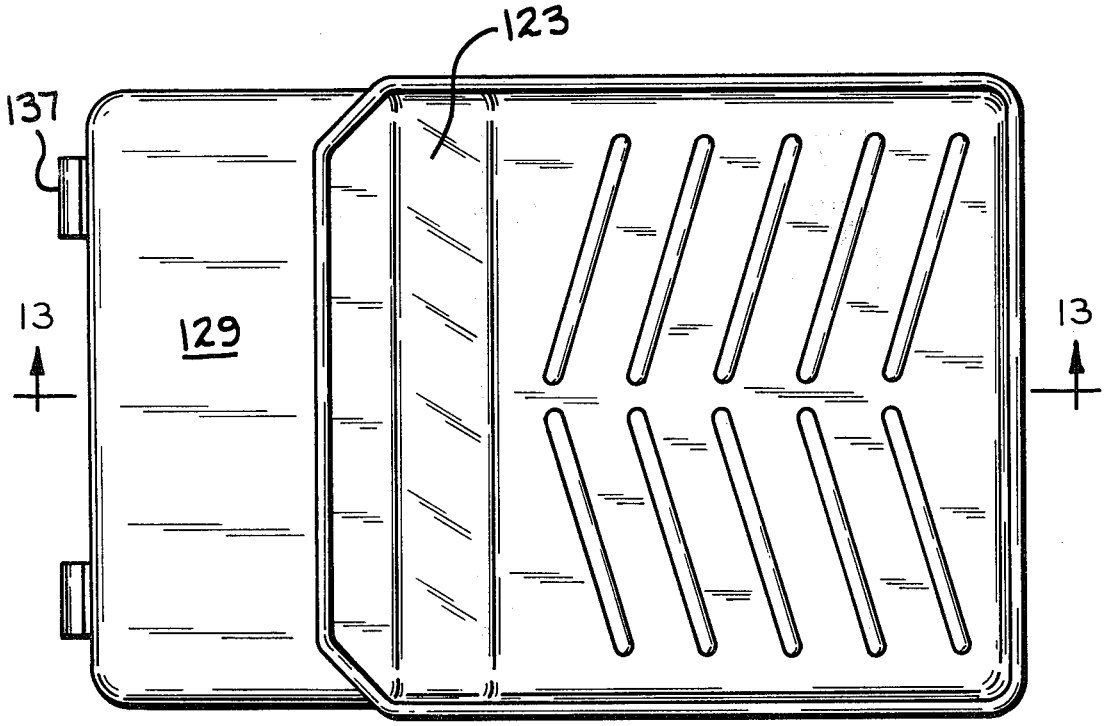
FIG. 10 is a plan view of the paint tray.
Figure 11:
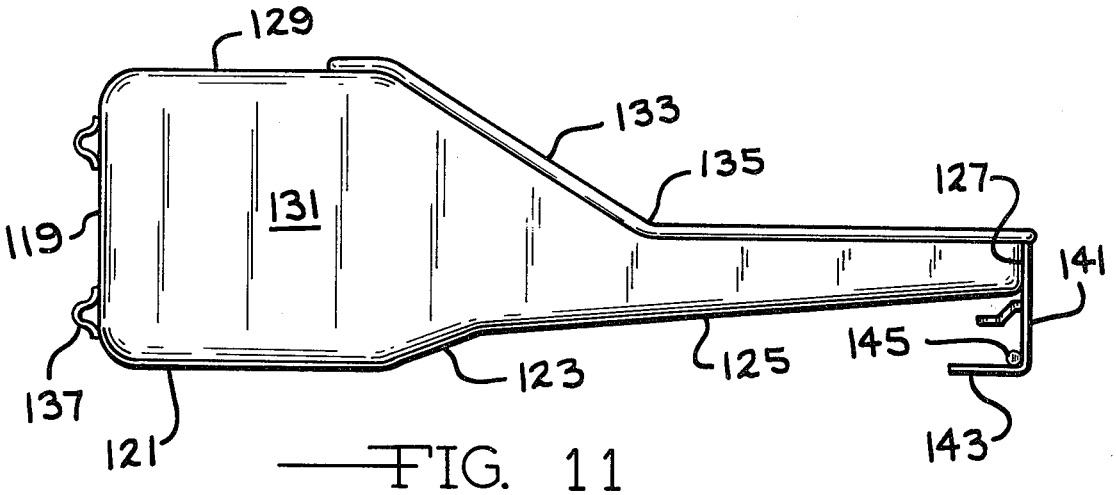
FIG. 11 is a side elevational view of the paint tray shown in FIG. 8.
Figure 12:
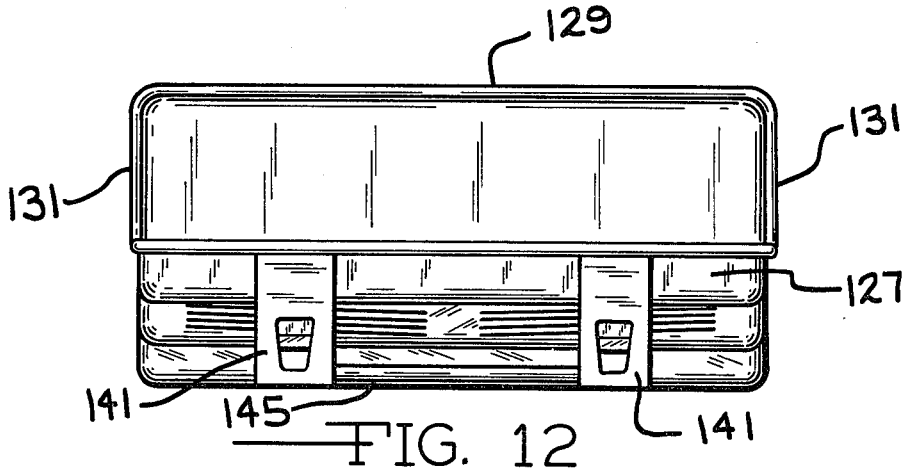
FIG. 12 is a rear elevational view of the paint tray.

Positioned on the front wall 119 of the paint tray 115 are brackets 137. The brackets extend from the front wall in a direction away from the enclosed portion of the paint tray. As shown in FIG. 9, the brackets 137 are arranged in two substantially parallel rows on the front wall 119. It should be noted that the brackets 137 extend from the front wall a substantially uniform distance.

Connected to the rear wall 127 are feet 141. The feet 141 extend from the rear wall in a direction that is substantially parallel to the rear wall 127. The feet 141 terminate in a support 143 that is positioned substantially perpendicular to the feet 141. The support 143 is substantially parallel and in alignment with the base 121. The support 143 also extends from the feet 141 in a direction toward the front wall 119. Normally at least two feet 141 will be positioned on the end of the paint tray where the rear wall 127 is located. The feet supply support for that end of the paint tray and maintain the paint tray in a substantially level position. A bar 145 can be positioned to extend between the two feet 141. In addition, a tab 147 can be formed in the foot 141. The tab terminates in a portion that is substantially parallel to the support 143.

Figure 8:
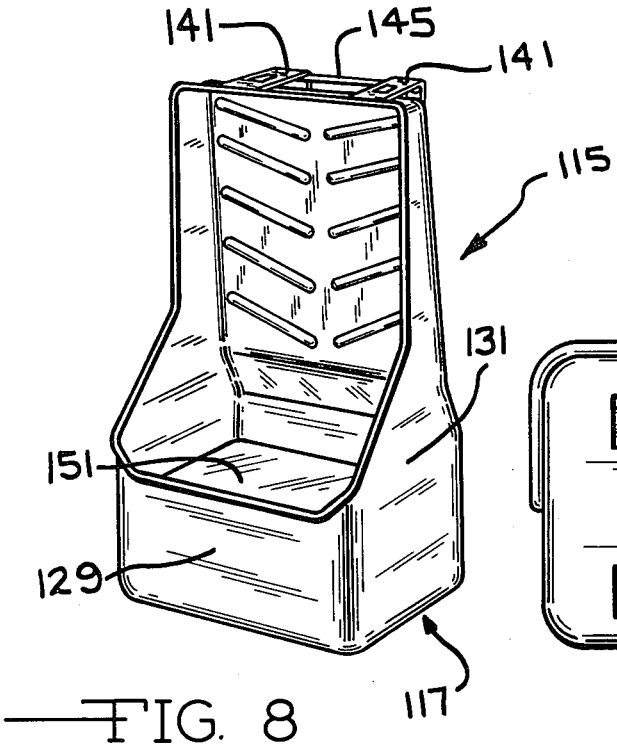
FIG. 8 is a perspective view of another embodiment of a paint tray that can be utilized with the paint tray support.
Figure 13:
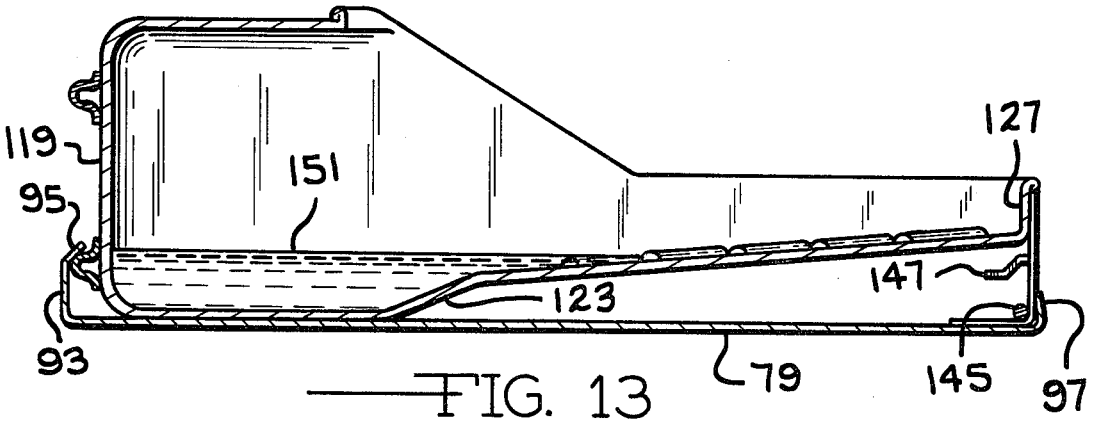
FIG. 13 is a cross sectional view of the paint tray taken along line 13—13 in FIG. 10.

In normal operation the material or paint 151 normally positioned in the paint tray 115 will be contained in the section of the tray adjacent the base 121 and transition section 123 as shown in FIG. 13. This is a normal position the paint tray 115 would assume when in use and when positioned on the support member 79. It is also possible to position the paint tray 115 on the front wall 119 as shown in FIG. 8. In this position the paint 151 will be contained in the enclosed end 117 defined by the base 121, front wall 119, top wall 129 and sidewalls 131. When the paint tray 115 is positioned in the manner shown in FIG. 8, the brackets 137 form a support surface upon which the paint tray can be positioned. The bar 145 that extends between the feet 141 provides a handle to facilitate the positioning or movement of the paint tray 115. It should be noted that the volume of the enclosed end 117 of the paint tray is sufficient to retain the quantity of paint 151 normally contained in such a paint tray.

The operation of the paint tray support will be more readily understood by referring to the attached drawings in connection with the following description.

Figure 2:
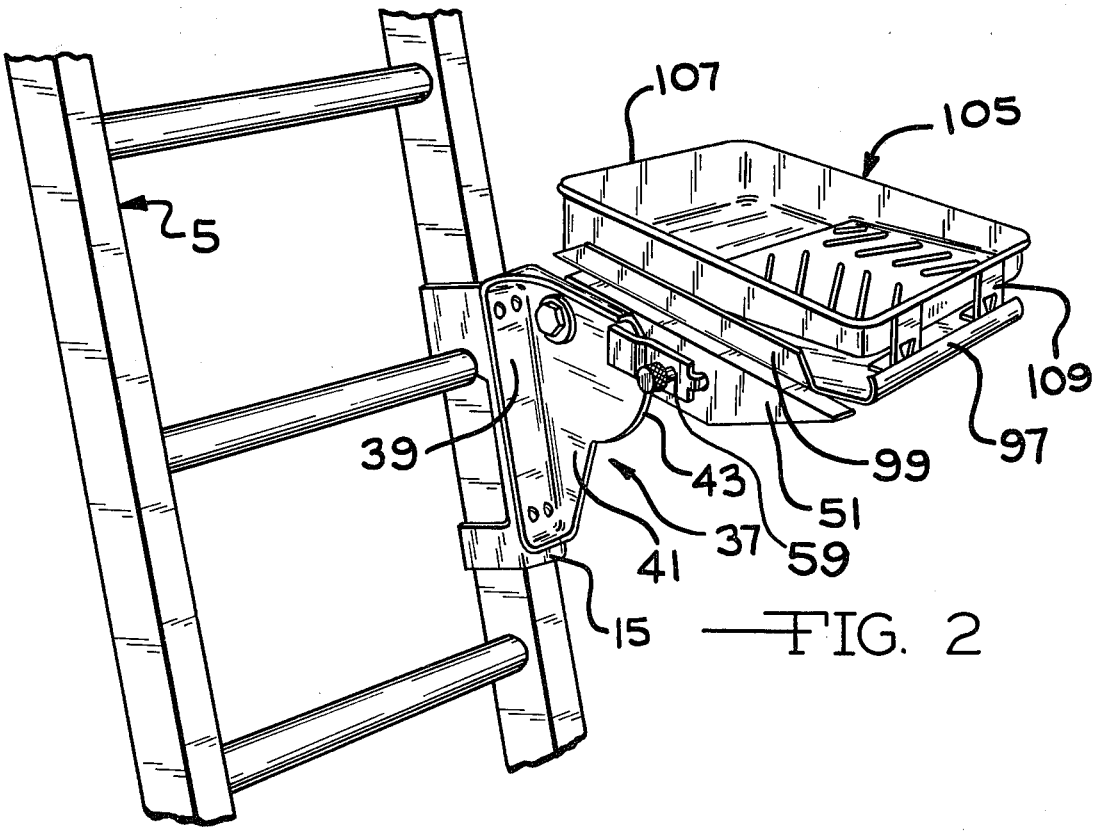
FIG. 2 is a perspective view of the paint tray support of the present invention.
Figure 3:
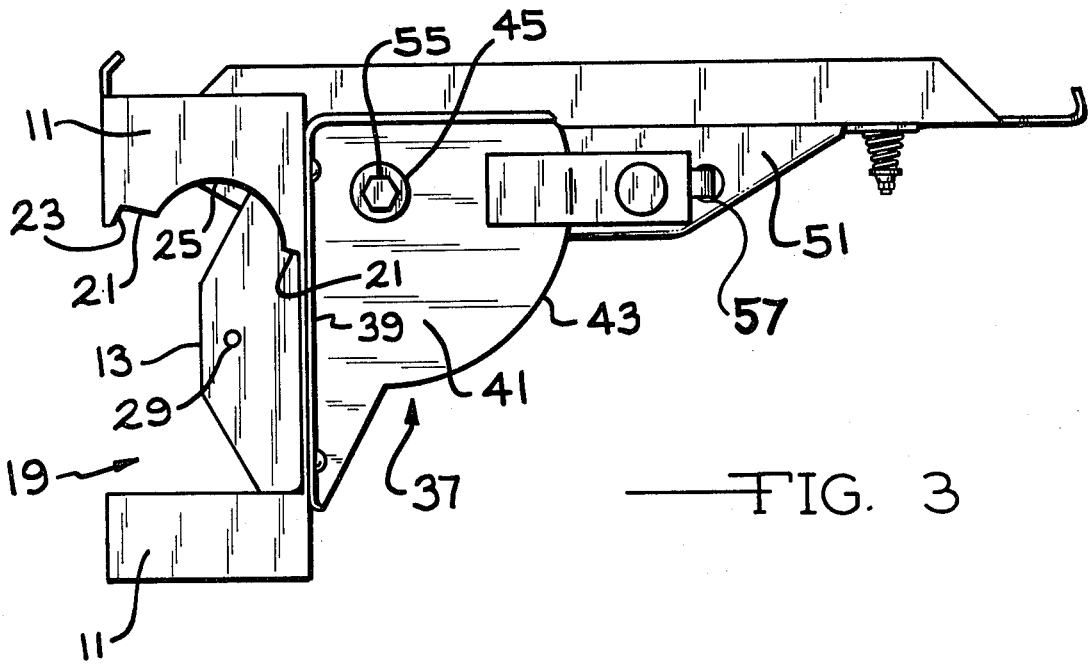
FIG. 3 is a side elevational view of the invention.
Figure 4:
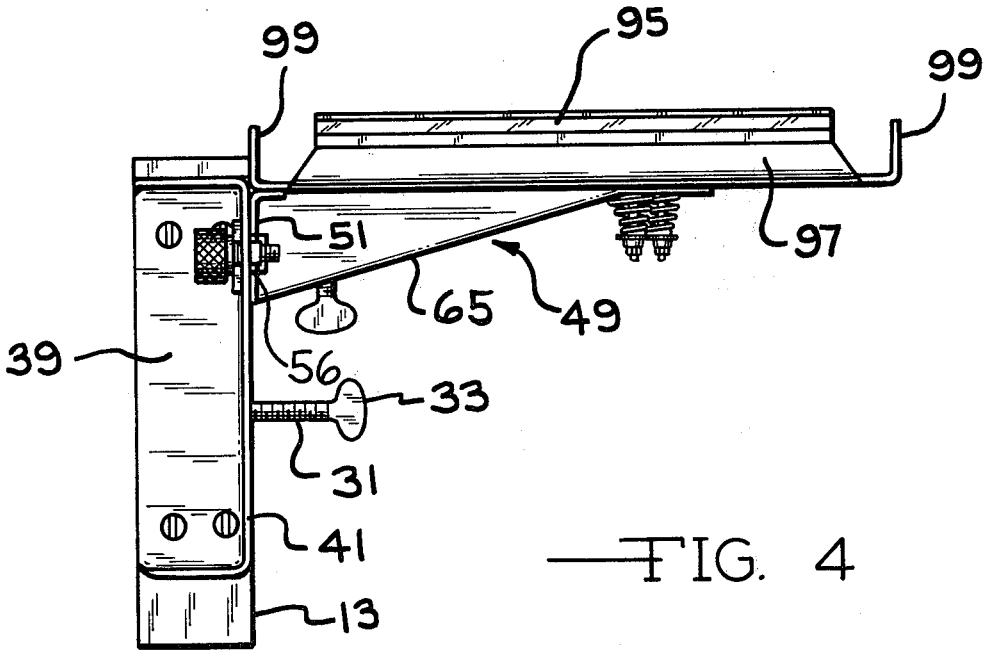
FIG. 4 is a rear elevational view of the paint tray support of the present invention.

The u-shaped bracket 9 of the paint tray support is positioned along the leg of the ladder to which the paint tray support is to be connected. The first leg 11 and second leg 13 of the u-shaped bracket 9 are positioned around the leg of the ladder. As shown in FIG. 1, the opening 19 in the first leg 11 is positioned so that the slot 21 engages the substantially rectangular step on the ladder. The projection 23 in the opening 19 is positioned so that it engages the edge of the step. If an extension ladder is being used as shown in FIG. 2, the opening 19 in the first leg 11 is positioned so that the radiused section 25 is in engagement with one of the rungs of the ladder. When the u-shaped bracket 9 is properly positioned and in engagement with the step or rung on the ladder the threaded bolt 31 can be advanced until it is in contact with the leg of the ladder to secure the u-shaped bracket 9 to the ladder.

The spacer 27 is positioned in the space between the first leg 11 and second leg 13 of the bracket 9 to allow the bracket to accommodate different size legs on a ladder. The spacer 27 is in contact with the second leg 13 and the third leg 15 of the bracket 9. As shown in FIG. 5, the spacer 27 is adjacent the edge of the thin ladder leg and helps to locate the leg within the bracket. If a thicker less deep ladder leg is present the spacer will be in contact with the edge of the leg and act to help position the bracket with respect to the leg. The spacer 27 also assists in ensuring that the slot 21 or radiused section 25 in the opening 19 is in proper alignment with the step or rung on the ladder.

With the u-shaped bracket 9 positioned on the ladder the second section 41 of the flange 37 extends from the ladder and provide a base to which the support member 79 can be attached. The support member 79 is pivotally attached to the second section 41 by bolt 55. Accordingly, the support member can be positioned in the desired relaship with the ladder by pivoting the support member with respect to the flange 37. Normally, it is desirable to have support member 79 substantially level. Once the support member 79 is in the proper position the knob 62 is rotated to engage the clamp member with the second section 41 of the flange 37. The clamp member 58 frictionally engages the second section 41 and prevents the support frame 59 and the support member 79 from rotating. The frictional engagement between the clamp member 58 and the second section 41 of the flange 37 is sufficient to maintain the support frame 49 and support members 79 in the desired location.

The clamp member 58 is prevented from rotating around the bolt 60 that secures the clamp member to the support frame 49 by tab 63. The tab extends from one end of the clamp member and the tab is positioned in the opening 57 in the support frame 49. The clamp member is prevented from rotating by the bolt 60 and the tab 63 which secure the clamp member to the support frame 49.

Once the paint tray support is positioned in the desired location on the ladder a paint tray 105 or a paint tray 115 can be positioned on the support member 79. The paint tray is positioned so that the brackets 137 on the front wall 119 of the paint tray engage the front wall 93 of the support member 79. The brackets are positioned on the paint tray to be adjacent the lip 95 on the front wall 93. In fact, the brackets will normally engage the lip and the lip will act to maintain the paint tray on the support member. And the feet for the paint tray located on the opposite end of the paint tray engage the back wall 97 on the support member 79. The paint tray also fits between the shoulder 99 located on each side of the support member 79. Thus, the paint tray is held in position on the support member.

Frequently the legs of the ladder are converging along the length of the ladder. The bracket 9 is positioned at the angle created by the leg of such a ladder. Accordingly, the second section 41 of the flange 37 is positioned at the same angle and this results in the support member 79 also being positioned at this angle. Because of the converging legs on such a ladder the support member will not be in a substantially level position and a paint tray positioned on the support member also will not be level. This non-level position is very undesirable for the proper utilization of the paint tray. To compensate for this angular position caused by the converging legs of the ladder the support member 79 is moveably positioned on the support frame 49. The support member is positioned on the support frame 49 by pins 81 that extend through apertures in the support member and the support plate 66 of the support frame 49. The pins 81 are biased by springs 83 to keep the support member in contact with the support plate 66. However, threaded bolt 87 which is positioned in the support plate 66 and has one end engaging the support member 79 can be rotated to raise or lower one side of the support member. In this manner the support member can be repositioned to eliminate the angular orientation created by generally converging legs of a ladder.

Having described the invention in detail and with reference to the drawings, it is understood that such specifications are given for the sake of explanation. Various modifications and substitutions, other than those cited, can be made without departing from the scope of the invention as defined by the following claims.

What I claim is:

1. An adjustable support for a paint tray for use on a ladder comprising:

a bracket for attaching to one of the legs of said ladder, said bracket containing a generally U-shaped member that fits over said leg of said ladder, a flange that is connected to said U-shaped member and a section for engaging one of said steps or rungs on said ladder;

a support member for said paint tray, said support member pivotally connected to said flange of said bracket, said support member having a raised portion at each end for engaging said paint tray;

means for pivotally securing said support member to said bracket, said means for securing being positioned on said flange; and a clamp positioned to engage a portion of said support member to releasably secure said support member with respect to said bracket.

2. The support of claim 1 wherein one leg of said generally U-shaped member is adapted with an opening for engaging one of the steps or rungs of said ladder.

3. The support of claim 2 wherein said opening in said leg of said generally u-shaped member defines a slot for engaging a generally rectangular step on a ladder and a radiused groove for engaging a rung on a ladder.

4. The support of claim 2 wherein said other leg of said generally u-shaped member opposite said leg with said opening is adapted with a clamp means for securing said bracket to said ladder.

5. The support of claim 4 wherein said clamp means includes a threaded bolt rotatably positioned in said other leg, said bolt being positioned to be capable of engaging said leg of said ladder to secure said bracket to said ladder.

6. The support of claim 1 wherein said support member is supported on a plurality of ribs and said ribs are pivotally connected to said flange of said bracket.

7. The support of claim 6 wherein said ribs contain a plurality of apertures and said support member contains pins moveably positioned in said apertures, said pins being biased to urge said support member into contact with said ribs.

8. The support of claim 7 wherein one of said apertures in said rib is threaded, a threaded bolt is rotatably positioned in said threaded aperture in said frame, one end of said bolt being in contact with said support member, rotataion of said bolt causing said support member and pins to move with respect to said support ribs.

9. The support of claim 6 wherein said clamp is positioned on said ribs and said clamp engages said flange to position said support member with respect to said bracket and said ladder.

10. The support of claim 9 wherein said support member has a front wall and back wall on opposite ends of said member for engaging said paint tray to maintain said paint tray in position on said support member.

11. The support of claim 10 wherein said paint tray contains a bracket on at least one end for engaging said front wall of said support member to assist in maintaining said paint tray in position on said support member.

12. The support of claim 11 wherein said front wall contains a lip that extends over said bracket on said paint tray to assist in maintaining said paint tray on said support member.

* * * * *